US010677514B2

(12) United States Patent
Bento et al.

(10) Patent No.: US 10,677,514 B2
(45) Date of Patent: Jun. 9, 2020

(54) DOOR BIN WITH DUAL MATERIAL AND SYSTEM LOCK

(71) Applicant: WHIRLPOOL CORPORATION, Benton Harbor, MI (US)

(72) Inventors: Edson Isaltino Bento, Joinville (BR); Luiz Afrânio Alves Ferreira, Joinville (BR); Guilherme Nehring, Joinville (BR); Ademar Testoni, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/050,421

(22) Filed: Jul. 31, 2018

(65) Prior Publication Data

US 2019/0041121 A1 Feb. 7, 2019

Related U.S. Application Data

(60) Provisional application No. 62/539,674, filed on Aug. 1, 2017.

(51) Int. Cl.

| | |
|---|---|
| ***F25D 23/04*** | (2006.01) |
| ***F25D 23/02*** | (2006.01) |
| ***F25D 25/02*** | (2006.01) |
| *F25D 23/06* | (2006.01) |

(52) U.S. Cl.

CPC ..... *F25D 23/04* (2013.01); *F25D 23/028* (2013.01); *F25D 25/02* (2013.01); *F25D 23/067* (2013.01); *F25D 2325/021* (2013.01)

(58) Field of Classification Search

CPC ..... F25D 23/04; F25D 23/028; F25D 25/02; F25D 2325/21; A47B 96/00; F16B 11/006

USPC ..... 312/405.1, 321.5, 245; 108/42

See application file for complete search history.

(56) References Cited

U.S. PATENT DOCUMENTS

| | | | |
|---|---|---|---|
| 774,117 | A | 11/1904 | Tandy |
| 1,952,148 | A | 3/1934 | Stout |
| 1,997,432 | A | 4/1935 | Replogle |
| 2,065,391 | A | 12/1936 | Nance |

(Continued)

FOREIGN PATENT DOCUMENTS

| | | | |
|---|---|---|---|
| BR | PI0100491 | B1 | 6/2009 |
| BR | 8802268 | U2 | 2/2010 |

(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

(Continued)

*Primary Examiner* — Janet M Wilkens

(74) *Attorney, Agent, or Firm* — Price Heneveld LLP

(57) ABSTRACT

A refrigerator door bin assembly includes a door liner defining a first side wall defining a supporting base extending from the first side wall. The supporting base defines a locking channel therein. The assembly further includes a bin body defining a first outer wall facing and positioned adjacent to the first side wall of the door liner. The first outer wall of the bin body defines an alignment channel receiving the supporting base therein. A locking rib extends within the alignment channel to engage with the locking channel.

21 Claims, 8 Drawing Sheets

(56) References Cited

U.S. PATENT DOCUMENTS 2,187,916 A 1/1940 Seeger
2,225,762 A 12/1940 Barnsteiner
2,282,342 A 5/1942 Preble
2,412,904 A 12/1946 Money et al.
2,434,117 A 1/1948 Money et al.
2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,266,858 A 8/1966 Klotz
3,295,904 A 1/1967 Cobb
3,410,260 A 11/1968 Morgan
3,866,437 A 2/1975 Spencer
3,984,163 A 10/1976 Boorman, Jr. et al.
4,597,616 A 7/1986 Trubiano
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,908,544 A * 3/1990 Lau ..... F25D 23/04 312/321.5
4,914,928 A 4/1990 Fellwock et al.
4,998,382 A 3/1991 Kostos et al.
5,088,801 A 2/1992 Rorke et al.
5,273,354 A 12/1993 Herrman et al.
5,362,145 A 11/1994 Bird et al.
5,411,165 A 5/1995 Ellis
5,415,472 A 5/1995 Brise
5,429,043 A 7/1995 Becker
5,447,146 A 9/1995 Nickerson
5,469,999 A 11/1995 Phirippidis
5,524,981 A 6/1996 Herrmann et al.
5,564,809 A 10/1996 Kane et al.
5,605,344 A 2/1997 Insalaco et al.
5,660,777 A 8/1997 Herrmann et al.
5,673,984 A 10/1997 Insalaco et al.
5,735,589 A 4/1998 Herrmann et al.
5,813,741 A 9/1998 Fish et al.
5,833,336 A 11/1998 Dean
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,578,720 B1 6/2003 Wang
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D547,640 S 7/2007 Remmers
D551,262 S 9/2007 Becke
7,270,385 B2 9/2007 Mathur et al.
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,814,287 B2 8/2014 Jang
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,103,582 B2 8/2015 Nash et al.
9,127,878 B2 9/2015 Gossens et al.
9,131,785 B2 9/2015 Peru
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,335,089 B1 5/2016 Gossens
9,339,993 B2 5/2016 Cites et al.
9,345,326 B2 5/2016 Sankhgond et al.
D761,884 S 7/2016 Austin et al.
9,453,673 B2 9/2016 Gossens
9,488,405 B2 11/2016 Lee et al.
9,500,403 B2 11/2016 Seo et al.
9,510,679 B2 12/2016 Bhatt et al.
9,574,820 B2 2/2017 Lee
9,671,115 B2 6/2017 Elkasevic
9,823,013 B1 11/2017 Caglin et al.

(56) References Cited

U.S. PATENT DOCUMENTS

| | | | | |
|---|---|---|---|---|
| 9,861,200 | B2 | 1/2018 | Lim | |
| 9,945,601 | B1 | 4/2018 | Bhavsar et al. | |
| 2003/0011291 | A1* | 1/2003 | Moreno-Olguin | F25D 23/04 312/405.1 |
| 2003/0020387 | A1 | 1/2003 | Wing et al. | |
| 2003/0080661 | A1* | 5/2003 | Ahmed | F25D 23/04 312/405.1 |
| 2003/0102787 | A1* | 6/2003 | Whitaker | F25D 23/04 312/405.1 |
| 2004/0012314 | A1 | 1/2004 | Hay et al. | |
| 2004/0104323 | A1 | 6/2004 | Hubert et al. | |
| 2004/0108779 | A1 | 6/2004 | Boettger et al. | |
| 2004/0108799 | A1* | 6/2004 | Leimkuehler | F25D 23/04 312/405.1 |
| 2005/0073225 | A1 | 4/2005 | Kwon et al. | |
| 2006/0042305 | A1 | 3/2006 | Oh et al. | |
| 2006/0049731 | A1 | 3/2006 | Choi et al. | |
| 2006/0145577 | A1 | 7/2006 | Daley et al. | |
| 2006/0226749 | A1 | 10/2006 | Kim | |
| 2006/0226751 | A1 | 10/2006 | Park | |
| 2007/0113578 | A1 | 5/2007 | Wu et al. | |
| 2007/0126325 | A1 | 6/2007 | Gorz et al. | |
| 2007/0228904 | A1 | 10/2007 | Williams | |
| 2007/0228908 | A1* | 10/2007 | Eveland | F25D 23/04 312/405.1 |
| 2007/0235397 | A1 | 10/2007 | Wannop | |
| 2008/0203041 | A1 | 8/2008 | Lim et al. | |
| 2008/0315743 | A1 | 12/2008 | Oh | |
| 2009/0193836 | A1 | 8/2009 | Ertz et al. | |
| 2010/0024464 | A1 | 2/2010 | Hwang et al. | |
| 2010/0102693 | A1 | 4/2010 | Driver et al. | |
| 2010/0109498 | A1 | 5/2010 | Ramm et al. | |
| 2010/0219731 | A1 | 9/2010 | Candeo et al. | |
| 2011/0001415 | A1 | 1/2011 | Park et al. | |
| 2011/0072846 | A1 | 3/2011 | Engel et al. | |
| 2011/0115356 | A1 | 5/2011 | Nash et al. | |
| 2012/0018434 | A1 | 1/2012 | Gwak | |
| 2012/0024006 | A1 | 2/2012 | Knoll et al. | |
| 2012/0091084 | A1 | 4/2012 | Amaral et al. | |
| 2012/0223038 | A1 | 9/2012 | Bean | |
| 2012/0248958 | A1 | 10/2012 | Ertz et al. | |
| 2013/0020922 | A1 | 1/2013 | Jang | |
| 2013/0119846 | A1 | 5/2013 | Seo et al. | |
| 2013/0147337 | A1 | 6/2013 | Lim | |
| 2013/0219731 | A1 | 8/2013 | Zhang | |
| 2014/0216095 | A1 | 8/2014 | Leclear et al. | |
| 2014/0217044 | A1 | 8/2014 | Cole | |
| 2015/0034668 | A1 | 2/2015 | Minard et al. | |
| 2015/0061484 | A1 | 3/2015 | Jeong et al. | |
| 2015/0068999 | A1 | 3/2015 | Dart et al. | |
| 2015/0107084 | A1 | 4/2015 | Craycraft et al. | |
| 2015/0168048 | A1 | 6/2015 | Sexton et al. | |
| 2015/0184929 | A1 | 7/2015 | Moon | |
| 2015/0351532 | A1 | 12/2015 | Peru | |
| 2016/0067863 | A1 | 3/2016 | Cole | |
| 2016/0290707 | A1 | 10/2016 | Burke et al. | |
| 2017/0086580 | A1 | 3/2017 | Conti | |
| 2017/0181538 | A1 | 6/2017 | Azkue et al. | |
| 2017/0276425 | A1 | 9/2017 | Fink et al. | |
| 2017/0341217 | A1 | 11/2017 | Cole | |
| 2018/0127007 | A1 | 5/2018 | Kravchenko | |
| 2019/0041122 | A1* | 2/2019 | Bento | F25D 25/021 |

FOREIGN PATENT DOCUMENTS

| | | | |
|---|---|---|---|
| BR | PI0805999 | A2 | 6/2010 |
| CA | 02421892 | * | 9/2004 |
| CA | 2484872 | A1 | 4/2006 |
| CN | 1975301 | A | 6/2007 |
| CN | 101611281 | A | 12/2009 |
| CN | 201779952 | U | 3/2011 |
| CN | 102135363 | A | 7/2011 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| CN | 102997580 | A | 3/2013 |
| CN | 203216196 | U | 9/2013 |
| CN | 101688748 | B | 12/2013 |
| CN | 103900317 | A | 7/2014 |
| CN | 104089457 | A | 10/2014 |
| CN | 104697286 | A | 6/2015 |
| CN | 104896859 | A | 9/2015 |
| CN | 105318639 | A | 2/2016 |
| CN | 205619680 | U | 10/2016 |
| CN | 205641793 | U | 10/2016 |
| CN | 205980510 | U | 2/2017 |
| CN | 106766627 | A | 5/2017 |
| DE | 8801508 | U1 | 6/1989 |
| DE | 700820 | T1 | 11/1996 |
| DE | 19750473 | A1 | 5/1999 |
| DE | 69519613 | T2 | 4/2001 |
| DE | 10107646 | A1 | 8/2002 |
| DE | 69529852 | T2 | 9/2003 |
| DE | 102005022516 | A1 | 11/2006 |
| DE | 102009045363 | A1 | 4/2011 |
| DE | 102011003037 | A1 | 7/2012 |
| DE | 102013216974 | A1 | 4/2014 |
| DE | 102012223131 | A1 | 6/2014 |
| EP | 0577939 | A1 | 1/1994 |
| EP | 700820 | A2 | 3/1996 |
| EP | 579364 | B1 | 12/1997 |
| EP | 940316 | A2 | 9/1999 |
| EP | 1152201 | A1 | 11/2001 |
| EP | 1790250 | A2 | 5/2007 |
| EP | 1349802 | B1 | 8/2008 |
| EP | 1985205 | A1 | 10/2008 |
| EP | 2072937 | A2 | 6/2009 |
| EP | 2098810 | A2 | 9/2009 |
| EP | 2431688 | A1 | 3/2012 |
| EP | 2424421 | B1 | 10/2015 |
| EP | 2760315 | B1 | 8/2016 |
| EP | 3076114 | * | 10/2016 |
| EP | 2926069 | B1 | 11/2016 |
| EP | 3159635 | A1 | 4/2017 |
| EP | 3327390 | A1 | 5/2018 |
| ES | 2327831 | T3 | 11/2009 |
| GB | 851667 | | 10/1960 |
| IN | 201737009466 | | 8/2017 |
| JP | 61124884 | S | 8/1986 |
| JP | 6212485 | S | 1/1987 |
| JP | 04278171 | H | 10/1992 |
| JP | 52126461 | U | 9/1997 |
| JP | H110115485 | A | 5/1998 |
| JP | H110122733 | A | 5/1998 |
| JP | H111237173 | A | 8/1999 |
| JP | 2002090054 | A | 3/2002 |
| KR | 100364994 | B1 | 12/2002 |
| KR | 374557 | B1 | 3/2003 |
| KR | 20030061668 | A | 7/2003 |
| KR | 100431346 | B1 | 5/2004 |
| KR | 1020040070986 | | 8/2004 |
| KR | 20040095421 | A | 11/2004 |
| KR | 100559722 | B1 | 3/2006 |
| KR | 100756887 | B1 | 9/2007 |
| KR | 850005 | B1 | 8/2008 |
| KR | 2010026614 | A | 3/2010 |
| KR | 20100023474 | A | 3/2010 |
| KR | 1020100022742 | * | 10/2010 |
| KR | 20130015988 | A | 2/2013 |
| KR | 20130016997 | A | 2/2013 |
| KR | 20140022598 | A | 2/2014 |
| KR | 2017043815 | A | 4/2017 |
| WO | 02014761 | A | 2/2002 |
| WO | 2004104504 | A1 | 12/2004 |
| WO | 2005012812 | A1 | 2/2005 |
| WO | 2005100887 | A1 | 10/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |

(56) References Cited

FOREIGN PATENT DOCUMENTS

| | | | |
|---|---|---|---|
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

European Search Report dated Jan. 4, 2019 from corresponding Application No. EP18186835.7.

* cited by examiner

DOOR BIN WITH DUAL MATERIAL AND SYSTEM LOCK

CROSS-REFERENCE TO RELATED APPLICATION

This application claims priority to and the benefit under 35 U.S.C. § 119(e) of U.S. Provisional Patent Application No. 62/539,674, filed on Aug. 1, 2017, entitled "DOOR BIN WITH DUAL MATERIAL AND SYSTEM LOCK", the entire disclosure of which is hereby incorporated herein by reference.

BACKGROUND

The present device generally relates to a door bin assembly for a refrigerator. More particularly, the door bin assembly includes snap fit arrangements of a bin body with a refrigerator liner and with a transparent interior wall.

Refrigerator door bins are generally known and can include a bin unit configured for removable assembly with a liner of the door. The configuration of the bin unit separate from the liner is generally a product of the material and process limitations associated with the liner, which is usually formed using a vacuum-forming process. The bin unit is generally more suitable for an injection molding or similar process. Accordingly, the bin unit and liner are separately made and must be assembled together. Most such assemblies facilitate selective placement of the bin within a number of available positions and ease of disassembly and repositioning of the bin by a consumer. Such assemblies, however, provide weak attachment between the bin unit and the associated liner, requiring additional fixation during shipping. Further, many bins are made of or include a transparent or translucent material, which may be in the form of an insert or the like assembled with a larger body

SUMMARY

In at least one aspect, a refrigerator door bin assembly includes a door liner defining a first side wall defining a supporting base extending from the first side wall. The supporting base defines a locking channel therein. The assembly further includes a bin body defining a first outer wall facing and positioned adjacent to the first side wall of the door liner. The first outer wall of the bin body defines an alignment channel receiving the supporting base therein. A locking rib extends within the alignment channel to engage with the locking channel.

In at least another aspect, a refrigerator door bin includes a bin body defining first and second opposite outer walls, the bin body being of an opaque material. The bin further includes an inner wall of a transparent material positioned between the first and second opposite outer walls and coupled with the bin body by an opening in one of the inner wall or the bin body receiving locking pawl therein. The locking pawl extends from the other of the bin body or inner wall.

In at least another aspect, a refrigerator includes a fresh food compartment defining an opening, a door closeable over at least a portion of the opening and a door liner defining a first side wall defining a supporting base extending from the first side wall. The supporting base defines a locking channel therein. A door bin includes a bin body defining a first outer wall facing and positioned adjacent to the first side wall of the door liner. The first outer wall of the bin body defines an alignment channel receiving the supporting base therein, and a locking rib extends within the alignment channel to engage with the locking channel.

These and other features, advantages, and objects of the present device will be further understood and appreciated by those skilled in the art upon studying the following specification, claims, and appended drawings.

DETAILED DESCRIPTION OF EMBODIMENTS

Figure 1:
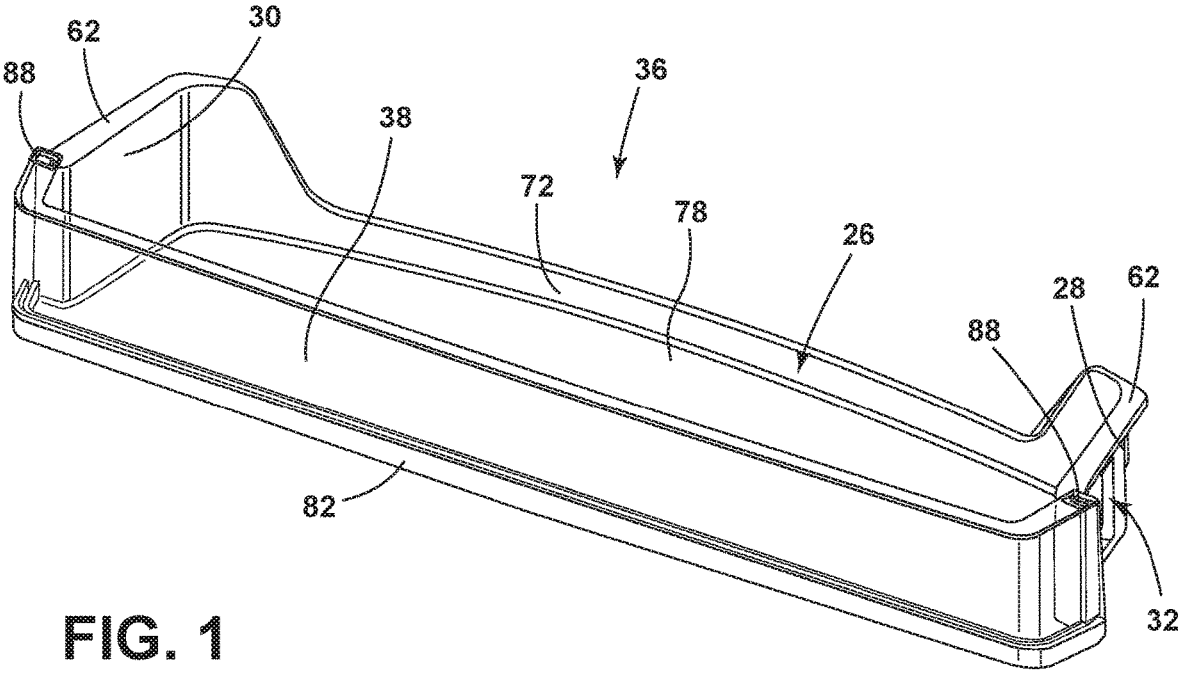
FIG. 1 is an inside perspective view of a door bin.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-11, reference numeral 10 generally designates a refrigerator door bin assembly. The door bin assembly 10 includes a liner 12 positioned along an interior of a door 14 in an associated refrigerator 16. The liner 12 defines first and second side walls 18, 20 spaced apart from and facing one another. Each of the first and second side walls 18, 20 define a respective supporting base 22 extending inwardly with respect to the associated one of the first and second side walls 18, 20. Each of the supporting bases 22 defines a locking channel 24 therein. The assembly 10 further includes a bin body 26 defining first and second outer walls 28, 30 facing and positioned adjacent to respective ones of the first and second side walls 18, 20 of the door liner 12. Each of the first and second outer walls 28, 30 of the bin body 26 defines a respective alignment channel 32 receiving a respective one of the supporting bases 22 therein. A locking rib 34 extends within the alignment channel 32 to engage with the locking channel 24.

Figure 2:
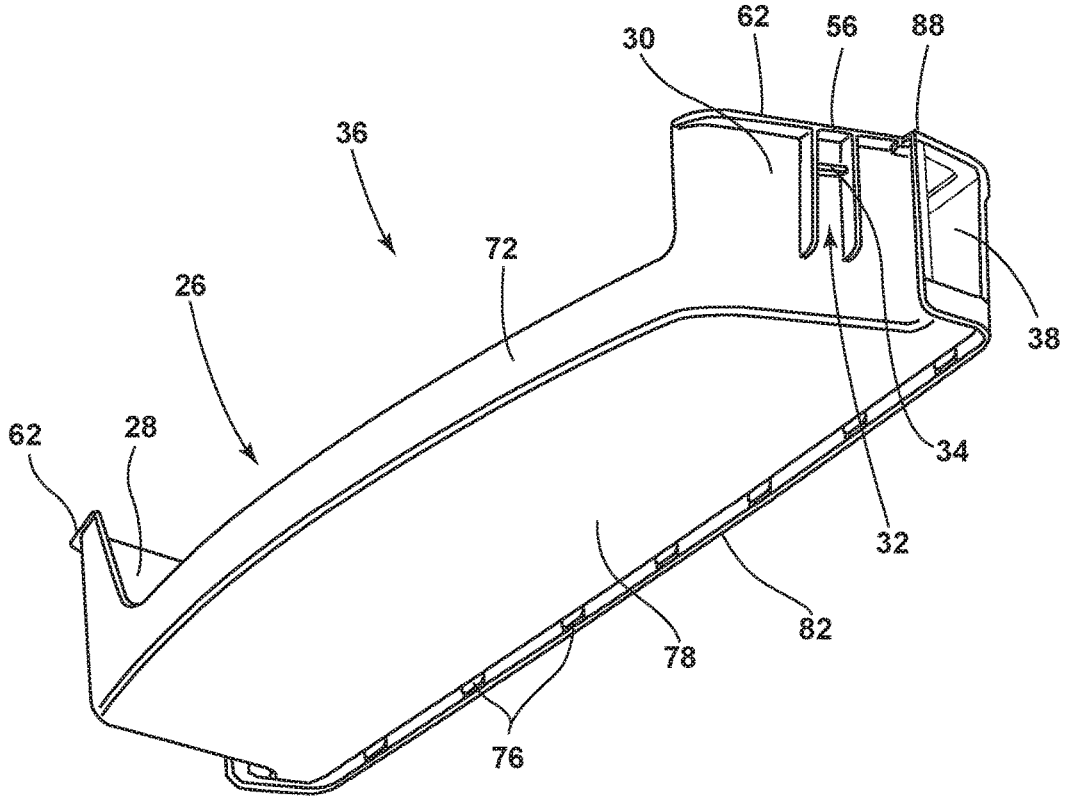
FIG. 2 is an outside perspective view of the door bin of FIG. 1.
Figure 10:
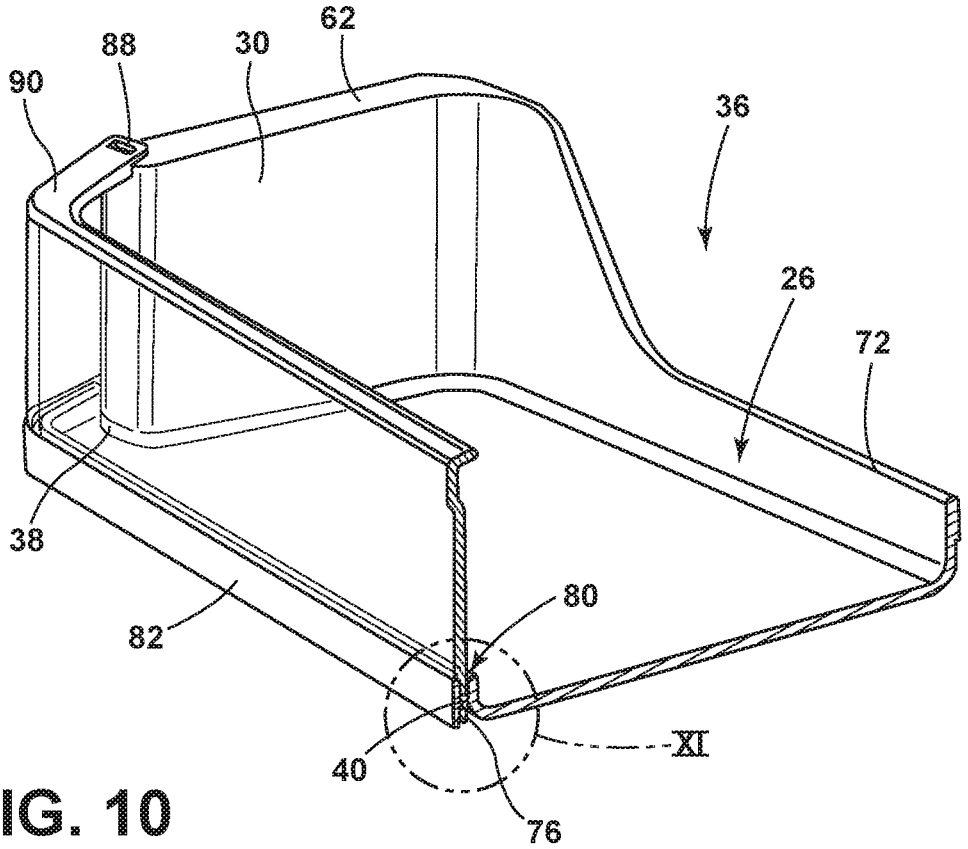
FIG. 10 is a cross-section view of the door bin unit of FIG. 7 showing an attachment arrangement of an inner wall of the door bin unit with a bin body.
Figure 11:
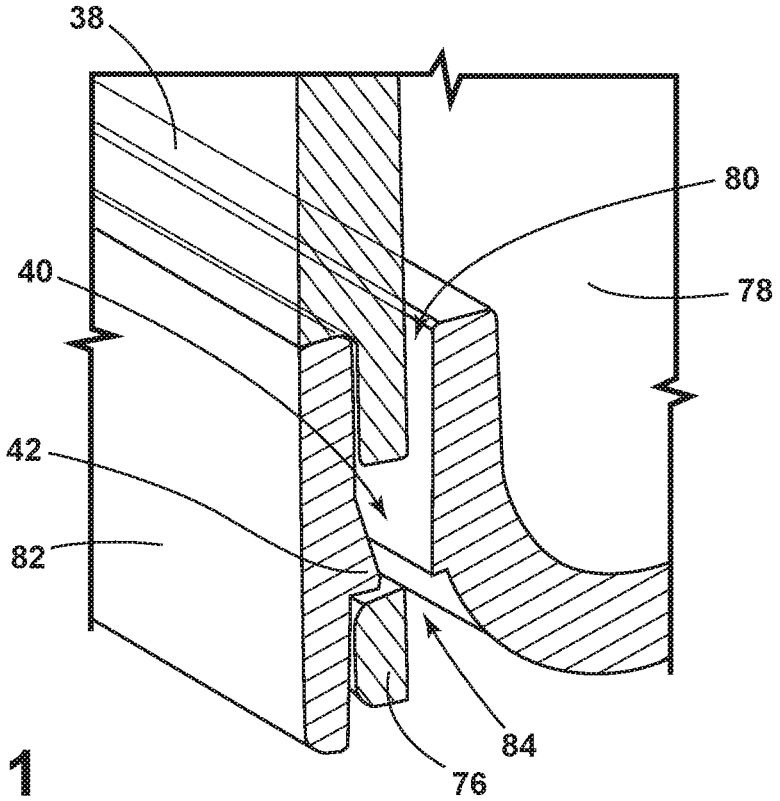
FIG. 11 is a detail view of the cross-section view of FIG. 10.

As shown in FIGS. 1 and 2, the bin body 26 of the bin assembly 10 (FIG. 7) is included in a bin unit 36 that includes a separate inner wall 38 of a transparent material, the bin body 26 being of an opaque material. The inner wall 38 is positioned between the first and second outer walls 28,30 of bin body 26 and is coupled with the bin body 26 by engagement between openings 40 in respective portions of the inner wall 38 and respective locking pawls 42 extending from the bin body 26 in locations aligned with the openings 40 such that the locking pawls 42 are respectively engaged with the openings 40, as shown in FIGS. 10 and 11 and discussed further below. It is noted that, although the embodiment shown and described herein includes the above-mentioned openings 40 and locking pawls 42 formed in the inner wall 38 and the bin body 26, respectively, a reversed arrangement is possible, wherein the openings 40 are formed in the bin body 26 and the locking pawls 42 are formed along the inner wall 38.

The locking arrangements between bin unit 36, by way of bin body 26, and door liner 12, as well as between inner wall 38 and bin body 26, can help to provide a robust bin assembly 10 that can be shipped without additional securement of inner wall 38 to bin body 26 or of bin body 26 to liner 12, which in other types of bin assemblies without such locking arrangements may be done using tape or the like. It is noted that such other types of assemblies may favor the ability of a consumer to easily adjust the positioning of door bins along a vertical height of the associated door. However, in many applications, at least a lower door bin can maximize utility be being positioned toward the bottom of the door. Even further, such door bins may not frequently, or ever, be adjusted or moved by the consumer, especially after the initial positioning of items in such bins. In this manner, a robust assembly may be favored over ease of adjustment. It is further noted that, depending on the particular configuration of the described locking arrangements, including with respect to material use, removal and repositioning of such bins may not be possible by the consumer.

Figure 3:
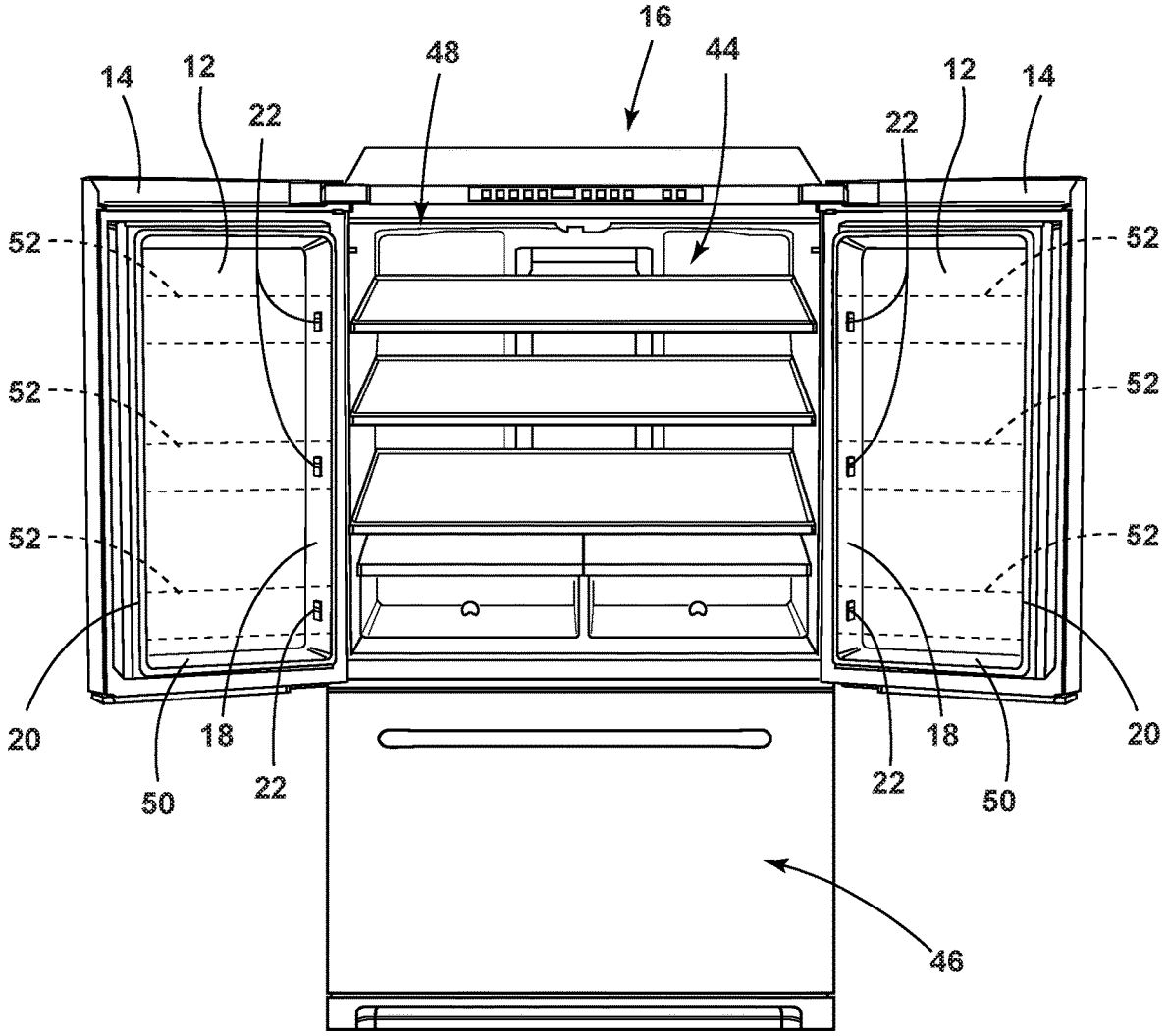
FIG. 3 is a front perspective view of a refrigerator having a door liner for assembly with the door bin of FIG. 1.
Figure 4:
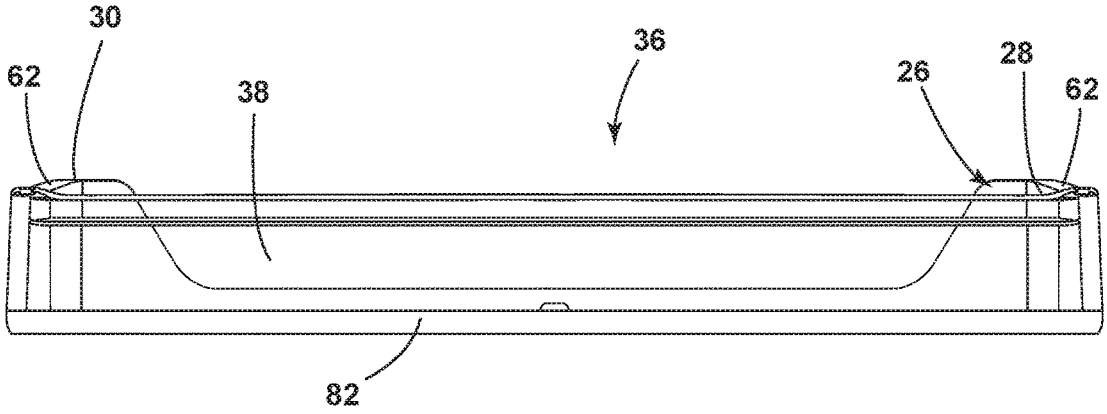
FIG. 4 is a front elevation view of the door bin of FIG. 1.
Figure 5:
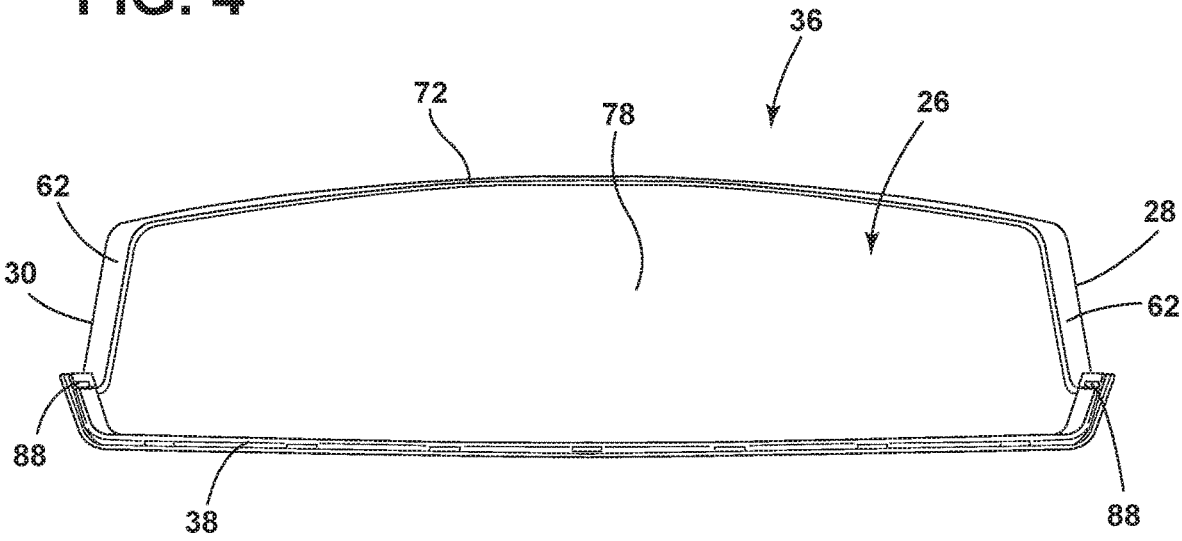
FIG. 5 is a top view of the door bin of FIG. 1.

Turning to FIG. 3, an example of a refrigerator 16, in which the herein-described bin assembly 10 may be implemented, is shown. In particular, the depicted refrigerator is shown as a French-door, bottom-mount ("FDBM") type refrigerator 16, in which a fresh food compartment 44 is positioned above a freezer compartment 46, and in which two separate outwardly-swinging doors 14 are used to close the opening 48 to the fresh food compartment 44. In this manner, the above-mentioned first and second side walls 18 and 20 can be opposite vertical segments of a door dyke 50 formed in liner 12 and generally surrounding the outer portion of the inside of door 14. As shown, supporting bases 22 can be formed in the door dyke 50 at various, horizontally-aligned positions along the included first and second side walls 18 and 20 to provide a plurality of positions 52 in which bin units 36 (FIGS. 1 and 2) can be assembled with door 14. In this manner, bin units 36 can be sized to extend across the width of the door dyke 50 (which corresponds generally with an overall width of the associated door 14) between side walls 18,20, such that the outer walls 28,30 (FIGS. 1 and 2) of bin body 26 (FIGS. 1 and 2) are appropriately positioned adjacent side walls 18,20 for receipt of supporting bases 22 are appropriately received within alignment channels 32 (FIGS. 1 and 2). In the depicted FDBM arrangement for refrigerator 16, bin positions 52 can be provided on both doors 14 by the appropriate incorporation of supporting bases 22 in the respective liners 12 of both doors 14 for the receipt of bin units 36 in such positions 52, the bin units 36 being generally symmetrical for positioning along either such door 14.

The bin assembly 10 described herein can also be implemented in other types of refrigerators, including single door bottom-mount arrangements or in both doors associated respectively with the fresh food compartment 44 and freezer compartment 46 in a single door top-mount arrangement or in a side-by-side refrigerator. In general, the door bin assembly 10 described herein can be adapted for such use simply by scaling the bin unit 36 to an appropriate width to correspond with the particular door 14 in which the assembly 10 is used.

Depending on the ultimate configuration of bin assembly 10, according to the structures and principles discussed herein, bin assembly 10 can result in bin units 36 that are intended to be affixed in a single position 52 along door 14 and not subsequently moved by the consumer. Although removal of bin body 26 from the resulting position 52 along door 14 may be possible, such removal may be made discouragingly difficult. Further, such movement may be discouraged by providing the same number of positions 52 as bin units 36 such that no alternative positions 52 for bins units 36 are available. Alternatively, bin units 36 may be made generally readily moveable (even at a generally higher removal or assembly force than other bin assembly arrangements), in which case additional, alternative positions 52 may be provided by the inclusion of additional pairs of supporting bases 22.

Figure 6:
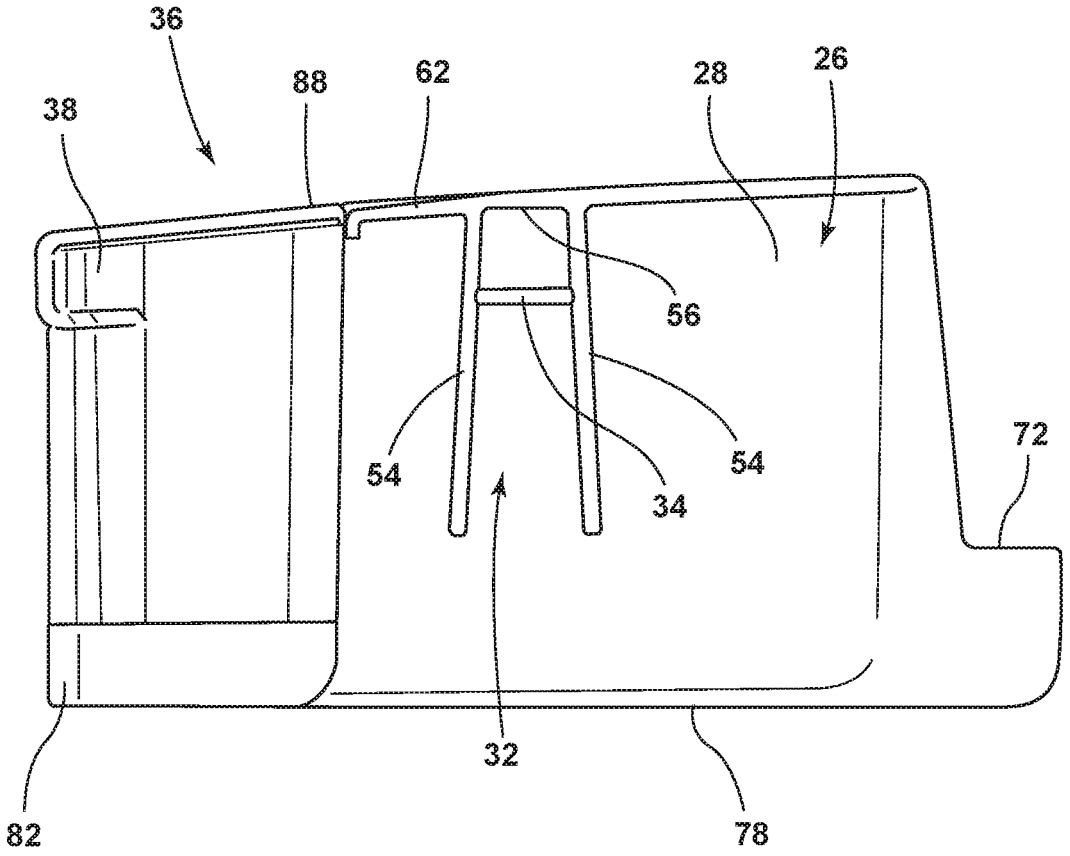
FIG. 6 is a side elevation view of the door bin of FIG. 1.

Turning to FIGS. 6-9, particular aspects of the engagement between supporting bases 22 and alignment channels 32 are described. As shown in FIG. 6, alignment channel 32 can be defined between opposite ribs 54 extending outwardly from the corresponding outside wall 28 or 30 of bin body 26. As illustrated, ribs 54 can extend predominately in a vertical direction with respect to bin body 26 and can be spaced apart from each other at a distance sufficient to receive a corresponding supporting base 22 therein. Ribs 54 can further taper somewhat toward each other in a direction toward the upper end 56 thereof. In this manner, engagement of supporting bases 22 (which can also taper inwardly along outer surfaces 58 toward an upper surface 60 thereof) within corresponding alignment channels 32 in a downward direction can cause supporting bases 22 to wedge into alignment channels 32. In turn, this may help retain bin body 26 in an assembled arrangement with liner 12. Such wedging can also help stabilize the assembly of bin body 26 with liner 12 and can prevent rattling of bin body 26 against liner 12, such as by vibration of refrigerator 16. The engagement of locking rib 34 with locking channel 24, described further below, can maintain bin body 26 in the assembled position with respect to liner 12 against the upward force resulting from the wedging of supporting bases 26 into alignment channels 32.

As further shown in FIG. 6, locking rib 34 extends between alignment ribs 54 in a generally horizontal manner. The end 56 of alignment channel 32 similarly extends between alignment ribs 54 in a horizontal manner with locking rib 34 spaced apart therefrom at a predetermined distance. In the illustrated embodiment, the end 56 of alignment channel 32 is defined along a section of an upper lip 62 of the outer walls 28, 30 of bin body 26 extending between alignment ribs 54, although a separate additional element (such as an additional rib) can define locking rib 34. In this manner, as further shown in FIGS. 7-9, alignment ribs 54 and lip 62 can extend laterally outwardly from outer walls 28, 30 to contact respective side walls 18, 20 of liner 12 with outer walls spaced apart therefrom to form a void in which supporting bases 22 are received. Such an arrangement allows a generally seamless appearance for the interior of bin body 26 that obscures the presence of alignment channel 32 and the associated support bases 22 (which is aided by the use of opaque material for bin body 26).

Figure 7:
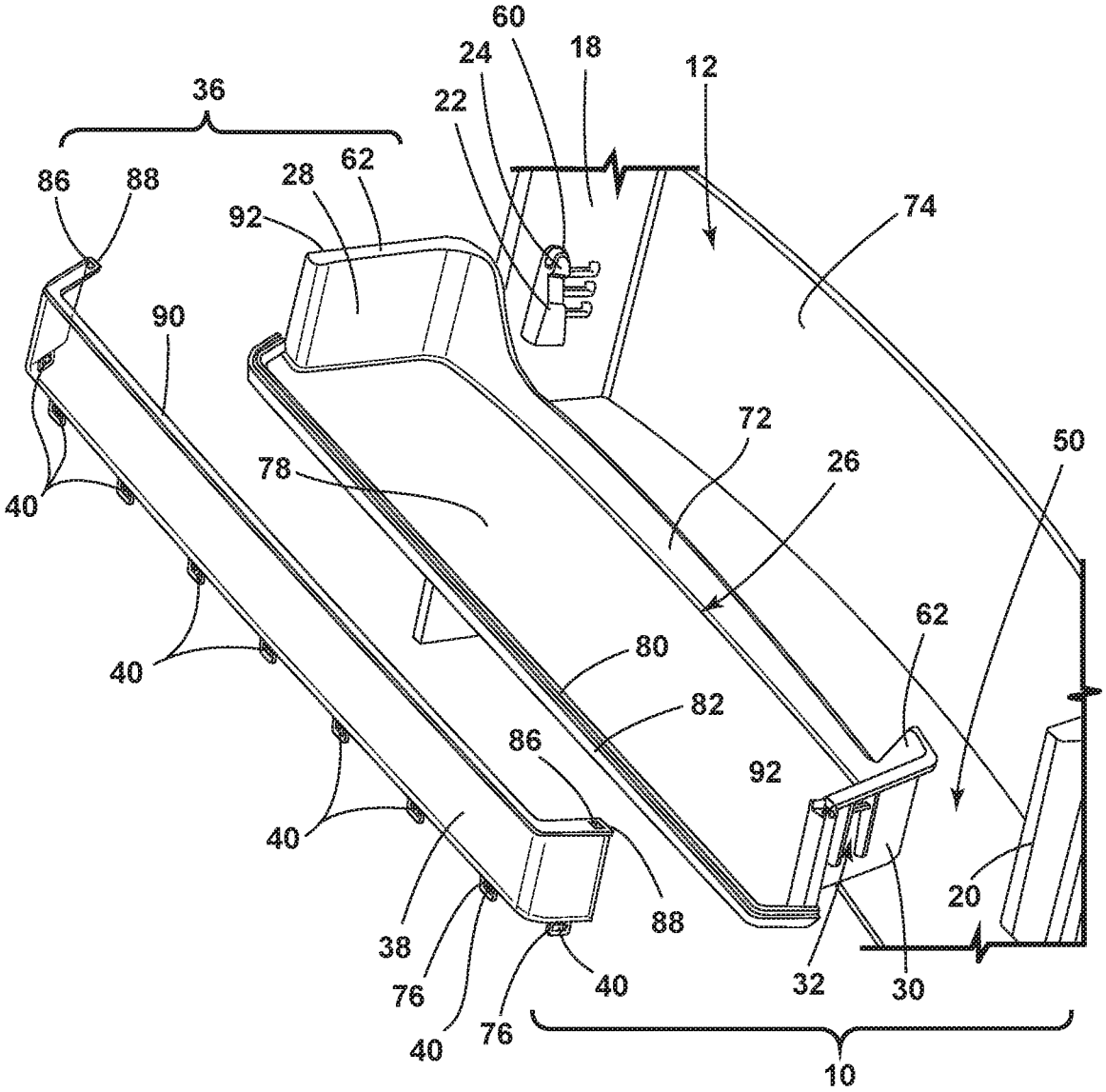
FIG. 7 is a perspective assembly view of a door bin unit and a door bin assembly of the unit with a refrigerator door liner.
Figure 8:
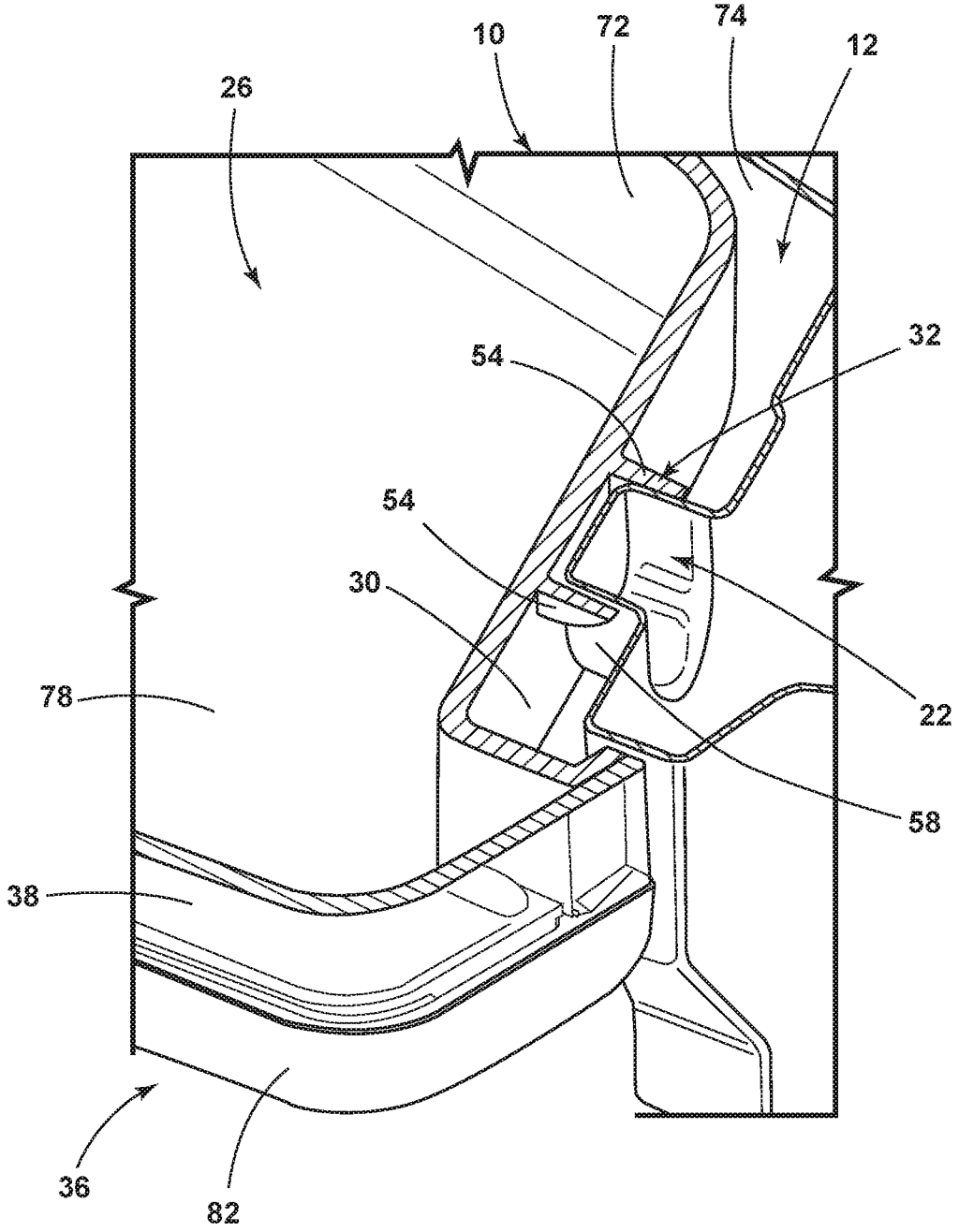
FIG. 8 is a cross-section view of the door bin assembly of FIG. 7.
Figure 9:
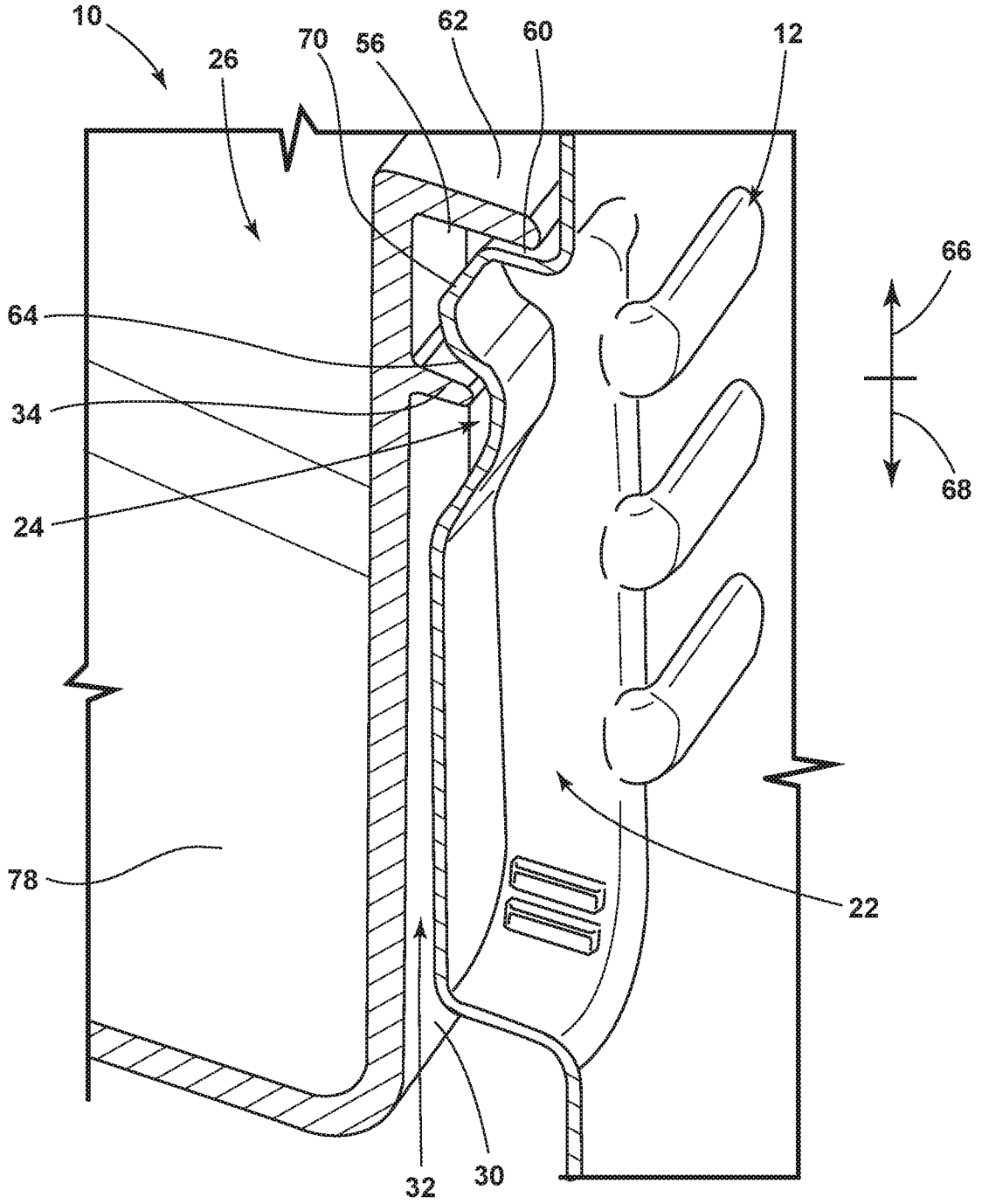
FIG. 9 is a further cross-section view of the door bin assembly of FIG. 7.

As illustrated in the assembly view of FIG. 7, as well as in the cross-section views of FIGS. 8 and 9, the engagement of supporting bases 22 within the corresponding alignment channels 32 positions locking rib 34 within locking channel 24 such that bin body 26 is maintained in place relative to liner 12. As shown in FIG. 7, supporting base 22 includes the above-mentioned upper surface 60 spaced apart vertically from the position of locking channel 24. The position of locking rib 34 relative to the end 56 of alignment channel 32 corresponds with the spacing between surface 60 and an upper portion of locking channel such that, when supporting base 22 is received with alignment channel 32 (including any compression or wedging, as discussed above) with end 56 of alignment channel 32 contacting upper surface 60 of supporting base 22, locking rib 34 is positioned within locking channel 24. More particularly, as shown in the cross section view of FIG. 9, locking rib 34 contacts an undercut surface 64 defining the upper portion of locking channel 24 and facing oppositely from upper surface 60. As can be appreciated, the configuration of undercut surface 64 relative to locking rib 34 can be derived to provide the desired retention characteristic of locking rib 34 within locking channel 24. For example, undercut surface 64 can be made longer and/or more horizontal relative to locking rib 34 to increase the force needed in removal direction 66 to dislodge locking rib 34 from locking channel 24, essentially, by movement of locking rib 34 over undercut surface 64 and out of locking channel 24 by way of compression of supporting base 22 in an area between locking channel 24 and upper surface 60, which may be facilitated by supporting base 22 being generally hollow due to the vacuum-forming process used to fabricate liner 12. Removal of locking rib 34 from locking channel 24 may be facilitated by a round are on outer portion of undercut surface 64 and/or the particular depth or angle of undercut surface 64. The lateral placement of alignment ribs 54 against the corresponding outer surfaces 58 of supporting base 22 (as shown in FIG. 8) serves to prohibit locking rib 34 from moving laterally out of locking channel 24.

As further shown in FIG. 9, when supporting base 22 is fully assembled within alignment channel 32, bin body 26 is vertically supported by the contact between end 56 of alignment channel 32 and upper surface 60 of support base 22. Such positioning can be achieved by alignment of bin body 26 in liner 12 with support bases 22 aligned with corresponding ones of the alignment channels 32 on the opposite outer walls 28, 30 (FIGS. 1 and 2). Bin body 26 can then be moved in the installation direction 68 to engage alignment channels 32 over supporting bases 22. Such movement will, at one stage, position locking ribs 34 against corresponding support bases 22. In the embodiment shown in FIG. 9, in such a position, locking ribs 34 will contact a tapered surface 70 that extends between upper surface 60 and undercut surface 64. In this manner, locking rib 34 can be sized relative to upper lip 62 (and, accordingly, end 56 of alignment channel 32) such that locking rib 34 extends outwardly by a lesser distance than upper lip 62. In one example, locking rib 34 can extend to between about 30% and about 70% of the distance to which upper lip 62 extends, and in a further example about 50% of the distance. In this manner, end 56 of alignment channel 32 can extend outwardly to be in a position to contact upper surface 60, whereas locking rib 34 is set inward relative to upper surface 60 to contact tapered surface 70. Accordingly, tapered surface 70 can be configured to allow locking rib 34 to move over tapered surface 70, including by compression of supporting base 22 in a similar manner to that which is discussed above with respect to removal of locking rib 34 from locking channel 24. As shown, tapered surface 70 can be more steeply angled than undercut surface 64 such that the force needed to engage locking rib 34 with locking channel 24 is less than the force needed for subsequent removal.

Returning to FIG. 7, when bin unit 36 and/or bin body 26 is assembled with liner 12, in the manner discussed above, a middle wall 72 of bin body 26 contacts an inner wall 74 of liner 12 to further support bin body 26 with respect to liner 12. In particular, such an arrangement can facilitate a cantilevered arrangement for bin unit 36, in which a lower shelf 78 of bin body 26 extends outwardly beyond door dyke 50. As shown, middle wall 72 can be tapered to a lower height than inner wall 38 or outer walls 28, 30 for weight savings and/or visual purposes with middle wall 72 being of a height sufficient for contacting inner wall 74 of liner 12 and to provide desired rigidity for bin body 26.

Continuing with respect to FIG. 7, and with additional reference to FIGS. 10 and 11, the attachment of inner wall 38 with bin body 26 is described. In the illustrated embodiment, the previously-described openings 40 can be positioned at generally regular intervals along a width of inner wall 38. Such intervals can be between about 2 cm and about 5 cm, for example, although other spacings are possible, as dictated by the configuration of and/or materials used for inner wall 38 and base body 26. As further shown, openings 40 can be defined on associated tabs 76 extending downwardly from a lower edge 78 of inner wall 38. As shown in FIG. 11, the tabs 76 can have a lesser material thickness than at least the portions of inner wall 38 from which they extend. In this manner, tabs 76 can extend into a channel 80 extending on the inner edge 82 of the shelf 78 defined on the lower portion of bin body 26. As further shown, the above-mentioned locking pawls 42 can be positioned within channel 80 such that tabs 76 can extend within channel 80 to position locking pawls 42 within openings 40 for securement of inner wall 38. In a further aspect, channel 80 may be generally closed with a plurality of slots 84 therethrough corresponding to the position of tabs 76 for receipt therethrough to allow flexing of tabs 76 over locking pawls 42 to position locking pawls 42 within openings 40, which can also be facilitated by outward flexing of the portions of bin body 26 bounding the slots 84 through channel 80. This arrangement facilities a robust snap-fit assembly of inner wall 38 with bin body 26. Again, it is noted that a reverse arrangement is possible, in which locking pawls 42 are positioned on tabs 76 and engage with openings 40 (which may be blind openings that could be further characterized as detents) within channel 80 or the like.

As further shown in FIGS. 7 and 10, detents 86 can be present along the upper ends 88 of inner wall 38, which may be defined along an upper lip 90 thereof. The detents 86 can engage with corresponding hooks 92 or the like present in adjacent portions of bin body 26, which can include along portions of outer walls 28, 30. Such engagement can retain the upper ends 88 of inner wall 38 in contact with outer walls 28, 30 along the respective heights thereof when inner wall 38 is assembled with bin body 26 by way of the above-described snap-fit of openings 40 on locking pawls 42.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator door bin assembly, comprising:

a door liner defining a first side wall defining a supporting base extending from the first side wall, the supporting base defining a locking channel therein and defining a wedge shape tapering outwardly along the first side wall in a direction away from an upper supporting surface thereof; and a bin body defining a first outer wall facing and positioned adjacent to the first side wall of the door liner, the first outer wall of the bin body defining an alignment channel receiving the supporting base therein, a locking rib extending within the alignment channel to engage with the locking channel, the alignment channel being outwardly tapered to match the wedge shape of the supporting base.

2. The refrigerator door bin assembly of claim 1, wherein:

the door liner further defines a second side wall spaced apart from the facing the first side wall;

each of the first and second side walls define a respective supporting base extending inwardly with respect to the associated one of the first and second side walls; and each of the supporting bases defines a locking channel therein.

3. The refrigerator door bin assembly of claim 2, wherein:

the bin body further defines a second outer wall;

each of the first and second outer walls face and are positioned adjacent to respective ones of the first and second side walls of the door liner; and each of the first and second outer walls of the bin body define a respective alignment channel receiving a respective one of the supporting bases therein, a respective locking rib extending within each alignment channel to engage therewith.

4. The refrigerator door bin assembly of claim 1, wherein the alignment channel includes a closed end contacting and supporting the bin body on an adjacent surface of the supporting base.

5. The refrigerator door bin assembly of claim 4, wherein the locking rib extends parallel with the closed end of the alignment channel and opposes movement of the bin body in a removal direction wherein the closed end of the channel moves away from the adjacent surface of the supporting base.

6. The refrigerator door bin assembly of claim 1, wherein:

the alignment channel is defined by first and second side ribs and an upper wall extending between the first and second side ribs, the locking rib also extending between the first and second side ribs generally parallel to the upper wall; and the locking rib is recessed with respect to the upper wall and the first and second side ribs.

7. The refrigerator door bin assembly of claim 1, wherein the supporting base defines an upper supporting surface and a planar inner face, the inner face being angled toward the first wall in a direction from the locking channel toward the supporting surface.

8. The refrigerator door bin assembly of claim 7, wherein the supporting base further defines a rounded edge between the face and the locking channel.

9. The refrigerator door bin assembly of claim 8, wherein:

a transition between the inner face and the upper supporting surface is spaced from the first side wall at a first distance; and the rounded edge extends to a second distance from the first side wall that is greater than the first distance.

10. The refrigerator door bin assembly of claim 1, further including an inner wall of a transparent material wall, wherein;

the bin body is of an opaque material.

11. The refrigerator door bin assembly of claim 10, wherein the inner wall is coupled with the bin body by an opening in one of the inner wall or the bin body receiving locking pawl therein, the locking pawl extending from the other of the bin body or inner wall.

12. A refrigerator door bin, comprising:

a bin body defining first and second opposite outer walls, the bin body being of an opaque material and including a plurality of hooks; and an inner wall of a transparent material positioned between the first and second opposite outer walls and coupled with the bin body by an opening in one of the inner wall or the bin body receiving locking pawl therein, the locking pawl extending from the other of the bin body or inner wall, the inner wall including an upper edge with a plurality of opposed detents on respective ends of the upper edge, wherein the plurality of hooks of the bin body respectively engage with the plurality of detents.

13. The refrigerator door bin of claim 12, wherein the opening is one of a plurality of openings in respective ones of a plurality of tabs extending from a lower surface of the inner wall.

14. The refrigerator door bin of claim 13, wherein the locking pawl extends from the bin body within a channel disposed along an inside edge of a shelf defined on a lower surface of the bin body, the tabs of the inner wall extending within the channel.

15. The refrigerator door bin of claim 14, wherein the bin body defines a generally flat outer surface opposite the channel, the inner wall extending generally flush with the generally flat outer surface.

16. The refrigerator door bin of claim 12, wherein the bin body defines a first outer wall and an alignment channel having a closed end and a locking rib extending parallel with the closed end.

17. The refrigerator door bin of claim 16, wherein the alignment channel is tapered to narrow toward the closed end.

18. The refrigerator door bin of claim 16, wherein:

the alignment channel is defined by first and second side ribs and an upper wall extending between the first and second side ribs to define the closed end, the locking rib also extending between the first and second side ribs generally parallel to the upper wall; and the locking rib is recessed with respect to the upper wall and the first and second side ribs.

19. A refrigerator, comprising:

a fresh food compartment defining an opening;

a door closeable over at least a portion of the opening;

a door liner defining a first side wall defining a supporting base extending from the first side wall, the supporting base defining an upper supporting face extending from the first side wall to a first distance and a planar inner face extending downwardly from the upper supporting face and angling away from the first side wall to a second distance greater than the first distance, the supporting base further defining a locking channel therein with a portion spaced from the first side wall at a third distance between the first and second distances; and a door bin including a bin body defining a first outer wall facing and positioned adjacent to the first side wall of the door liner, the first outer wall of the bin body defining an alignment channel receiving the supporting base therein, a locking rib extending within the alignment channel to engage with the locking channel.

20. The refrigerator of claim 19, wherein:

the door liner further defines a second side wall spaced apart from and facing the first side wall;

each of the first and second side walls define a respective supporting base extending inwardly with respect to the associated one of the first and second side walls; and each of the supporting bases defines a locking channel therein.

21. The refrigerator door bin assembly of claim 19, wherein:

the alignment channel is defined by first and second side ribs and an upper wall extending between the first and second side ribs, the locking rib also extending between the first and second side ribs generally parallel to the upper wall; and the locking rib is recessed with respect to the upper wall and the first and second side ribs such that the upper wall is positionable on the upper supporting face with the locking rib in the locking channel by engagement of the locking rib with the planar inner face and movement thereof into the locking channel.

* * * * *